US011248624B2

(12) United States Patent
Lin et al.

(10) Patent No.: US 11,248,624 B2
(45) Date of Patent: Feb. 15, 2022

(54) CENTRIFUGAL COMPRESSOR

(71) Applicant: INDUSTRIAL TECHNOLOGY RESEARCH INSTITUTE, Hsin-Chu (TW)

(72) Inventors: Jun-Jie Lin, Yilan County (TW); Jenn-Chyi Chung, Changhua County (TW); Chung-Che Liu, Hsinchu (TW); Kuo-Shu Hung, Hsinchu (TW)

(73) Assignee: INDUSTRIAL TECHNOLOGY RESEARCH INSTITUTE, Hsin-Chu (TW)

( * ) Notice: Subject to any disclaimer, the term of this patent is extended or adjusted under 35 U.S.C. 154(b) by 42 days.

(21) Appl. No.: 16/815,403

(22) Filed: Mar. 11, 2020

(65) Prior Publication Data

US 2021/0131447 A1 May 6, 2021

(30) Foreign Application Priority Data

Nov. 5, 2019 (TW) ..... 108140048

(51) Int. Cl.
*F04D 29/46* (2006.01)
*F04D 27/02* (2006.01)
*F04D 17/10* (2006.01)

(52) U.S. Cl.
CPC ..... *F04D 29/464* (2013.01); *F04D 17/10* (2013.01); *F04D 27/0246* (2013.01); *F05B 2240/14* (2013.01)

(58) Field of Classification Search
CPC ..... F04D 29/464; F04D 27/0246; F04D 17/10
See application file for complete search history.

(56) References Cited

U.S. PATENT DOCUMENTS 4,292,807 A * 10/1981 Rannenberg ..... F04D 29/464 60/601
4,417,851 A * 11/1983 Cygnor ..... F04D 29/468 415/150

(Continued)

FOREIGN PATENT DOCUMENTS

CN 201475041 U 5/2010
CN 201865981 U 6/2011

(Continued)

OTHER PUBLICATIONS

Taiwan Patent Office, "Notice of Allowance", Taiwan, dated Mar. 18, 2020.

*Primary Examiner* — Woody A Lee, Jr.
*Assistant Examiner* — Behnoush Haghighian
(74) *Attorney, Agent, or Firm* — Locke Lord LLP; Tim Tingkang Xia, Esq.

(57) ABSTRACT

A centrifugal compressor includes a volute base block, a volute cover plate, an impeller, a diffuser-adjusting assembly, a radial constraint assembly, an axial constraint assembly and a driving assembly. A diffuser and a connected volute are formed between the cover plate and the base block. The impeller discharges gas to the centrifugal compressor through the diffuser and the volute. The diffuser adjustment assembly includes a driving ring, a driving rod, a pin and a diffuser ring. The radial constraint assembly is disposed on an inner circumference surface of the driving ring. The axial constraint assembly on an outer circumference surface of the driving ring is located between the top and bottom portions. The drive assembly is to rotate the driving ring. When the driving ring rotates, the pin slides along the pin track, and the driving rod displaces the diffuser ring to adjust a flow-path width of the diffuser.

9 Claims, 14 Drawing Sheets

(56) References Cited

U.S. PATENT DOCUMENTS

| | | | | |
|---|---|---|---|---|
| 4,527,949 | A * | 7/1985 | Kirtland | F01D 17/143 415/150 |
| 4,643,639 | A * | 2/1987 | Caine | F04D 29/468 277/412 |
| 5,116,197 | A | 5/1992 | Snell | |
| 5,807,071 | A * | 9/1998 | Brasz | F04D 27/0253 415/150 |
| 6,872,050 | B2 | 3/2005 | Nenstiel | |
| 7,356,999 | B2 | 4/2008 | Bodell, II et al. | |
| 8,734,093 | B2 * | 5/2014 | Yen | F04D 29/462 415/164 |
| 9,885,370 | B2 * | 2/2018 | Fang | F04D 29/281 |
| 10,208,758 | B2 * | 2/2019 | Chung | F04D 29/083 |
| 10,330,115 | B2 * | 6/2019 | Chung | F04D 29/464 |
| 10,502,232 | B2 * | 12/2019 | Mohtar | F04D 29/444 |
| 10,544,808 | B2 * | 1/2020 | Mohtar | F16K 3/03 |
| 10,550,761 | B2 * | 2/2020 | Lombard | F04D 29/4206 |
| 2008/0138200 | A1 * | 6/2008 | Umeyama | F04D 29/464 415/204 |
| 2012/0286066 | A1 * | 11/2012 | Holroyd | F01D 17/143 239/265.11 |
| 2014/0328667 | A1 | 11/2014 | Sommer et al. | |
| 2017/0350417 | A1 * | 12/2017 | Maier | F04D 29/4206 |
| 2020/0149466 | A1 * | 5/2020 | Vuletic | F04D 29/464 |
| 2020/0309142 | A1 * | 10/2020 | Steiner | F04D 27/0246 |

FOREIGN PATENT DOCUMENTS

| | | | |
|---|---|---|---|
| CN | 203532279 | U | 4/2014 |
| CN | 102478026 | B | 10/2014 |
| CN | 204061335 | U | 12/2014 |
| CN | 104131999 | B | 7/2017 |
| TW | I418711 | B | 12/2013 |
| TW | I437167 | B | 5/2014 |
| TW | I507606 | B | 11/2015 |

* cited by examiner

CENTRIFUGAL COMPRESSOR

CROSS REFERENCE TO RELATED APPLICATION

This application claims the benefits of Taiwan application Serial No. 108140048, filed on Nov. 5, 2019, the disclosures of which are incorporated by references herein in its entirety.

TECHNICAL FIELD

The present disclosure relates in general to a centrifugal compressor.

BACKGROUND

The centrifugal compressor is a device that utilizes an impeller to work on gas in a centrifugal manner so as to boost the pressure and the velocity of the gas while passing through the impeller. When the impeller rotates at a high speed, the gas is driven to rotate therewith, and is centrifugally thrown off into the following diffuser. Simultaneously, a vacuum state is formed at the impeller so as thereby to draw fresh exterior gas into the impeller, and the gas is accelerated there and then thrown off the impeller into the diffuser. Thereupon, the gas can be kept flowing.

For example, the centrifugal chiller, as one of conventional equipment having the centrifugal compressor, is usually furnished with a method for controlling the device capacity. This method is mainly to control both the rotational speed of the centrifugal compressor and the open degree of the inlet guide vane (IGV) at the gas inlet, so as to meet instant loading and thus regulate capacity of the chiller. However, while the centrifugal chiller works at a low load condition or under a situation of rising pressure difference, since the mass flow rate of gas can't overcome the pressure difference, forced conveyance of the gas to the high-pressure end would be stopped. In this circumstance, gas at the high-pressure end would flow reversely back to the low-pressure end. When the pressure at the low-pressure end rises, the concerned pressure difference would be reduced. Till the pressure difference is reduced into a region that the compressor impeller can be restarted to convey the gas from the low-pressure end to the high-pressure end, then the flow of the gas would be back to normal. At this time, the pressure difference will rise gradually again. Till the pressure difference rises to a degree that the impeller can't afford again, the reverse flow would occur again to flow the gas from the high-pressure end to the low-pressure end. Thereupon, such a reciprocating flow would generate an ill flow phenomenon called as "surge".

In the art, the surge phenomenon only happens to the centrifugal compressor. For a typical constant speed drive centrifugal chiller to avoid the aforesaid surge phenomenon, a common resort for resolving or lessening the surge phenomenon is to adjust the open degree of the inlet guide vane and to bypass the high-pressure gas to the low-pressure end, such that this centrifugal chiller can still work at the low load condition without the surge phenomenon. Thereupon, possible damage upon the compressor caused by the surges can be reduced to a minimum.

Nevertheless, since the conventional inlet guide vane is disposed at the impeller, then when the open degree of the inlet guide vane decreases, notorious noises would be generated. Hence, an improvement to provide a centrifugal compressor for avoiding the aforesaid problems is definitely urgent and welcome to the skill in the art.

SUMMARY

An object of the present disclosure is to provide a centrifugal compressor that can adjust a flow-path width of the diffuser by changing the structural arrangement of the compressor. Thereupon, with the surge to be avoided and the noise to be reduced, the simply-structured centrifugal compressor featured in working silently of this disclosure is obviously superior to the conventional design.

In this disclosure, the centrifugal compressor includes a volute base block, a volute cover plate, an impeller, a diffuser-adjusting assembly, at least three radial constraint assemblies, at least three axial constraint assemblies and a driving assembly. The volute cover plate, disposed inside the volute base block, forms a diffuser and a volute in between with the volute base block, in which the volute connects spatially with the diffuser. The impeller has an outlet connected spatially with the diffuser. The diffuser-adjusting assembly, movably disposed inside the volute base block, includes a driving ring, at least three driving rods, at least three pins and a diffuser ring. The driving ring is rotationally disposed on the volute cover plate, the driving ring includes at least three drive-rod slots and at least three pin tracks, each of the at least three drive-rod slots is disposed at the driving ring and structured to penetrate through a top portion and a bottom portion of the driving ring, each of the at least three pin tracks is disposed on an outer circumference surface of the driving ring, each of the at least three driving rods is connected with the corresponding pin, each of the at least three driving rods penetrates through the corresponding drive-rod slot and the volute cover plate, one end of each of the at least three driving rods is connected with the diffuser ring, the diffuser ring is located close to the diffuser, and each of the at least three pins is movably disposed in the corresponding pin track. Each of the at least three radial constraint assemblies is disposed to an inner circumference surface of the driving ring. Each of the at least three axial constraint assemblies is disposed to the outer circumference surface of the driving ring by being located between the top portion and the bottom portion. The driving assembly, used for rotating the driving ring, includes a drive device, a coupling, a drive shaft, a crank, a universal slider and a slider-driven slotted block. The slider-driven slotted block is fixed on the driving ring, the universal slider is movably disposed in the slider-driven slotted block, and one end of the crank is connected with the universal slider while another end thereof is connected with the drive shaft. When the drive device rotates the drive shaft, the drive shaft drives the crank to swing about the drive shaft, such that the universal slider moves reciprocally along the slider-driven slotted block and rotates the driving ring simultaneously; wherein, when the driving ring rotates, each of the at least three pins slides along the corresponding pin track, and thus each of the at least three driving rods is driven to displace the diffuser ring, so that a flow-path width of the diffuser is adjusted.

As stated, the centrifugal compressor provided by this disclosure connects the volute base block externally with the driving assembly, and thus rotational motion of the driving assembly can be transformed into linear motion of the diffuser ring via the driving ring. Thereupon, the flow-path width of the diffuser can be adjusted, the centrifugal compressor can work at a low load condition, and the surge phenomenon upon the compressor can be avoided by adjusting the flow-path width of the diffuser.

Further, since this disclosure discards the conventional design of locating the impeller into the inlet guide vane, thus notorious noise can be avoided, the structuring can be more concise, and a more silent operation can be obtained.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
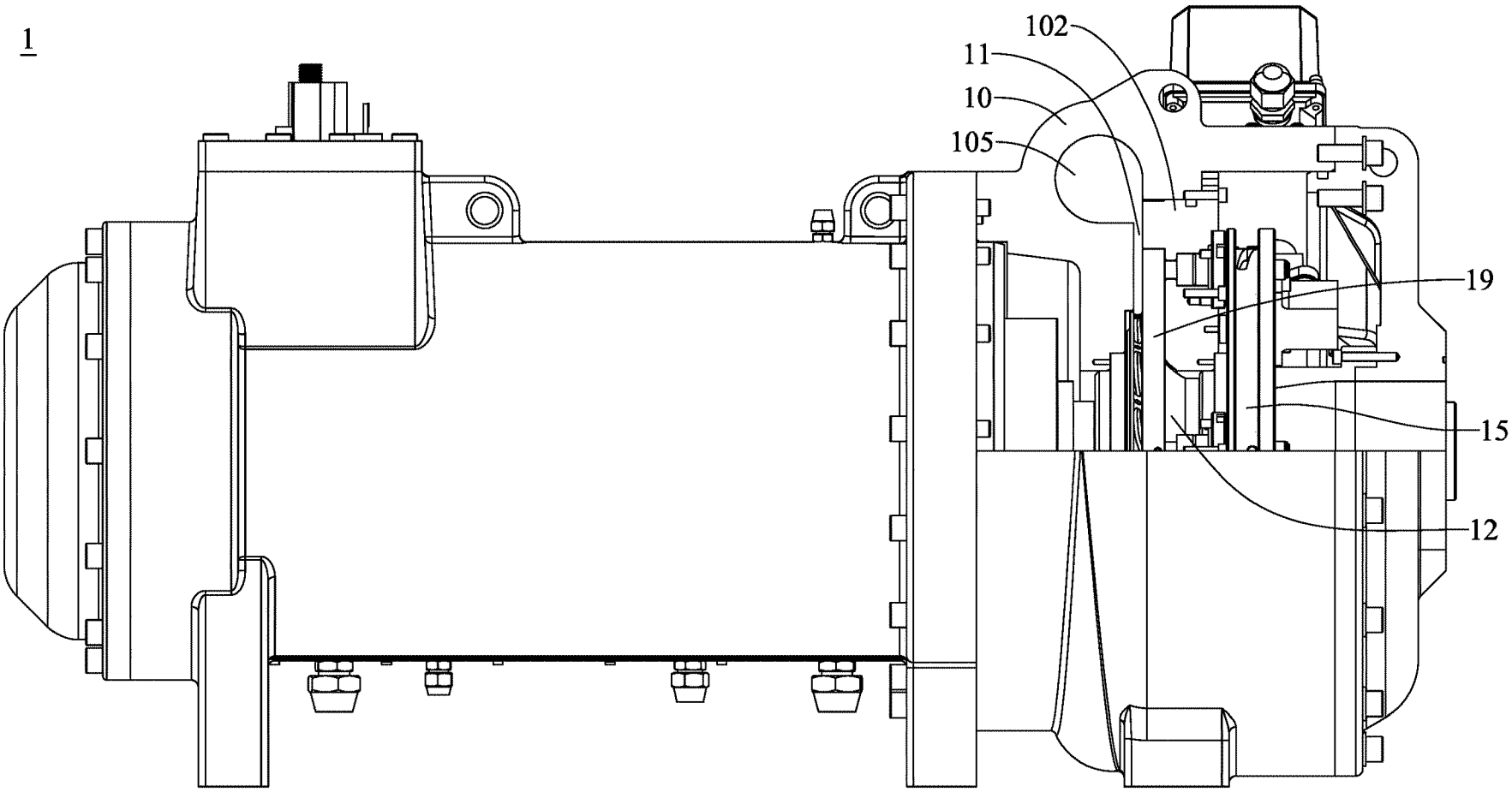
FIG. 1 is a schematic view of an embodiment of the centrifugal compressor in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
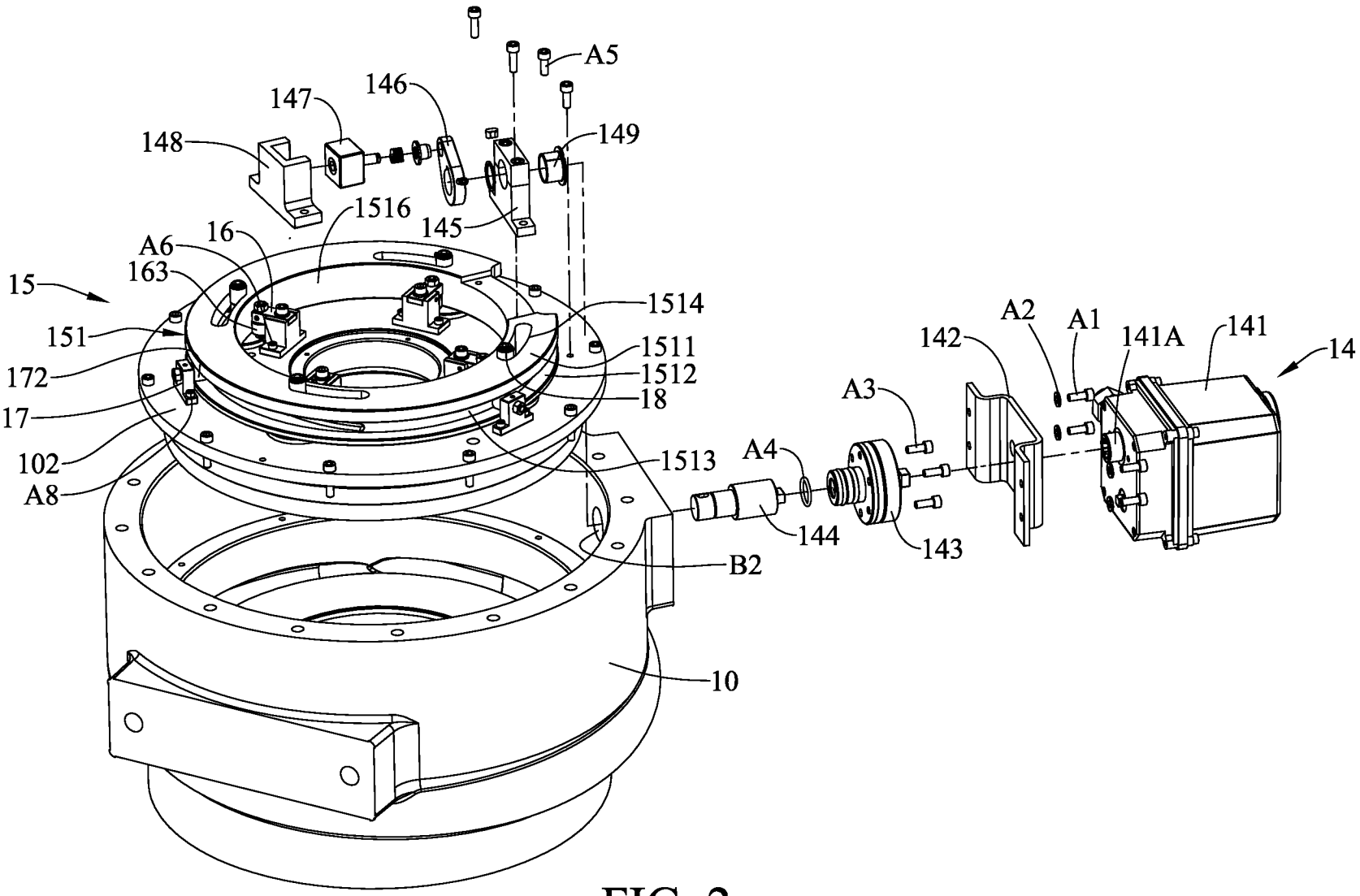
FIG. 2 is a schematic exploded view of a portion of FIG. 1.
Figure 3:
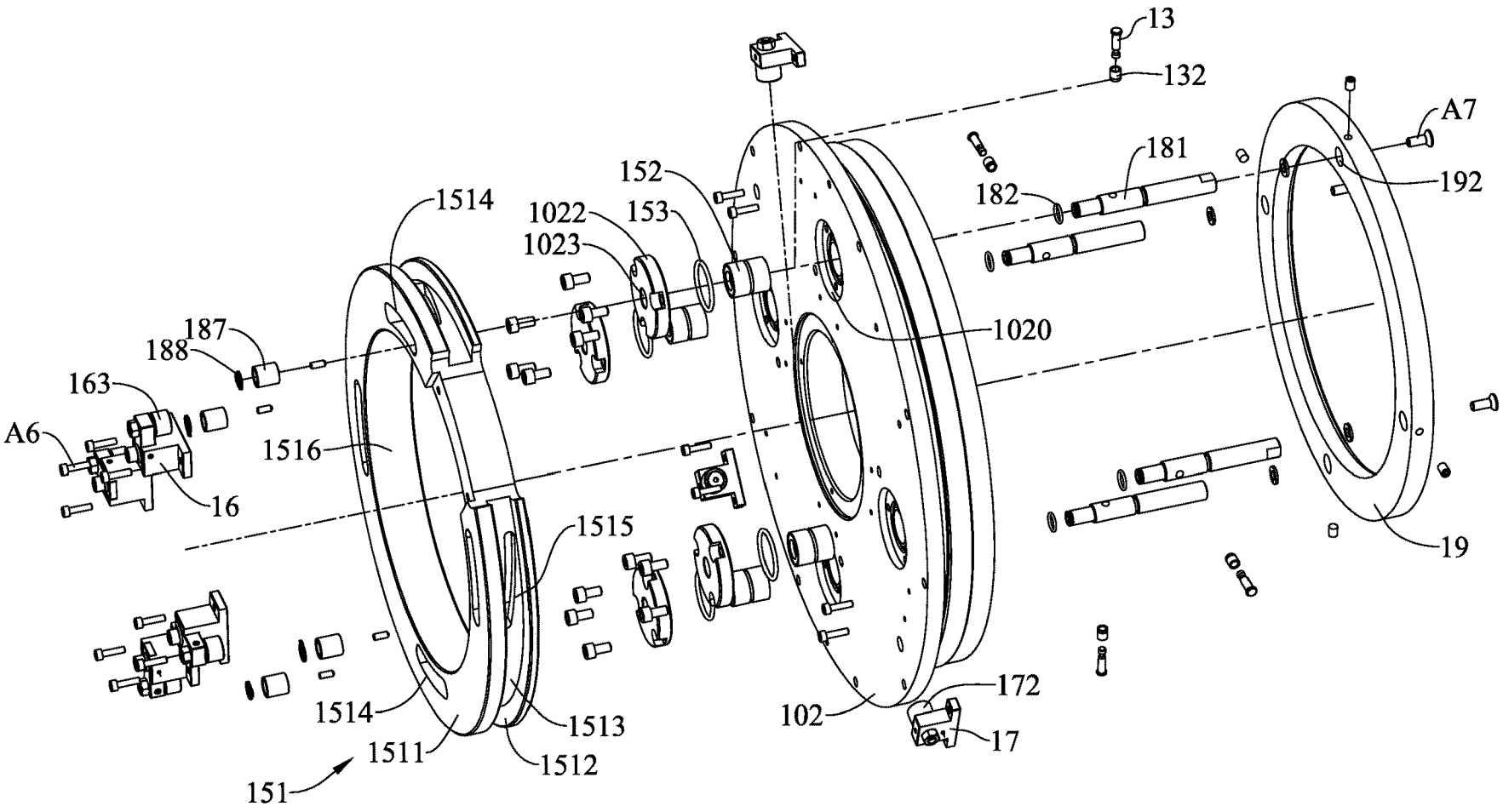
FIG. 3 is a schematic exploded view of the diffuser-adjusting assembly of FIG. 2.

Refer now to FIG. 1 through FIG. 3; where FIG. 1 is a schematic view of an embodiment of the centrifugal compressor in accordance with this disclosure, FIG. 2 is a schematic exploded view of a portion of FIG. 1, and FIG. 3 is a schematic exploded view of the diffuser-adjusting assembly of FIG. 2. As shown, in this embodiment, the centrifugal compressor 1 includes a volute base block 10, a volute cover plate 102, an impeller 12, a driving assembly 14, a diffuser-adjusting assembly 15, at least three radial constraint assemblies 16 and at least three axial constraint assemblies 17. The volute cover plate 102, disposed inside the volute base block 10, forms a space in between with the volute base block 10 to accommodate a diffuser 11 and a volute 105 connected spatially with the diffuser 11. Also, the diffuser 11 connects spatially an outlet of the impeller 12, so that the impeller 12 can rotationally discharge the gas directly to the diffuser 11. The diffuser-adjusting assembly 15, movably disposed inside the volute base block 10, is used for adjusting a flow-path width of the diffuser 11. In this embodiment, the flow-path width is directed to the spacing in the diffuser 11.

In this embodiment, the diffuser-adjusting assembly 15 includes a driving ring 151, at least three driving rods 18, at least three pins 13 and a diffuser ring 19, in which the driving ring 151 is rotationally disposed on the volute cover plate 102. In detail, the driving ring 151 includes a top portion 1511, a bottom portion 1512, an outer circumference surface 1513, at least three drive-rod slots 1514, at least three pin tracks 1515 and an inner circumference surface 1516; in which both the outer circumference surface 1513 and the inner circumference surface 1516 are formed between the bottom portion 1512 and the top portion 1511 by opposing each other. Each of the drive-rod slots 1514 is disposed at the driving ring 151 and structured to penetrate through both the top portion 1511 and the bottom portion 1512. Each of the pin tracks 1515 is disposed on the outer circumference surface 1513 of the driving ring 151 by being located between the top portion 1511 and the bottom portion 1512. The quantity of the pin tracks 1515 is equal to that of the drive-rod slots 1514. For example, as shown in FIG. 3, the quantity of either the pin tracks 1515 or the drive-rod slots 1514 is four. However, specifically, the quantity of the drive-rod slots or the pin tracks is determined in accordance with practical requirements.

In this embodiment, each of the driving rods 18 penetrates through one corresponding drive-rod slot 1514 and also the volute cover plate 102. One end of the driving rod 18 is connected with the diffuser ring 19 located close to the diffuser 11, as shown in FIG. 6B.

In detail, each of the driving rods 18 includes a rod body 181, an O-ring 182, a bushing 187 and a C-shape retaining ring 188. The volute cover plate 102 is furnished thereon with a plurality of bearing-mounting bores 1020 (four shown in this embodiment), and each of the bearing-mounting bores 1020 is paired with a bearing cover 1022 in a position corresponding to one respective driving rod 18. The bearing cover 1022 is disposed to fit one corresponding bearing-mounting bore 1020. One end of the rod body 181 is mounted through the bushing 187 and the C-shape retaining ring 188, and is specifically sealed with the O-ring 182. This end of the rod body 181 penetrates orderly through the bearing-mounting bore 1020 of the volute cover plate 102, a center hole 1023 of the bearing cover 1022 and the drive-rod slot 1514.

On the other hand, another end of the rod body 181 is introduced to fit into a corresponding counterbore 192 on the diffuser ring 19 and fixed by a locking element A7. In this embodiment, the counterbore 192 is formed as a step hole. Thereupon, while the driving rod 18 displaces in an axial direction of the driving ring 151, the diffuser ring 19 is moved synchronously with the driving rod 18, such that the flow-path width of the diffuser 11 can be adjusted. In one embodiment of this disclosure, the diffuser-adjusting assembly 15 further includes at least three bearings 152. In this embodiment, the bearing 152 can be a linear-motion bearing or a self-lubricating bearing. The bearing 152 is housed fixedly by the bearing cover 1022, and then this combination is mounted into the corresponding bearing-mounting bore 1020 of the volute cover plate 102. Each of the bearings 152 sleeves and thus mounts the corresponding driving rod 18. When the driving rod 18 displaces in the axial direction of the driving ring 151, the corresponding bearing 152 is moved synchronously. In this embodiment, the driving rod 18 supported by the corresponding bearing 152 undergoes a reciprocating linear motion in the axial direction. In addition, in some other embodiments, an O-ring 153 can be applied into the bearing cover 1022 so as to enforce the sealing thereof.

In this embodiment, each of the driving rods 18 is provided with a pin 13. The pin 13 penetrates through the bushing 132 to be further fixed to a lateral side of the driving rod 18. While the driving rod 18 penetrates through the corresponding drive-rod slot 1514 and the volute cover plate 102, the corresponding pin 13 is slidably disposed in the pin track 1515 (i.e., to slide along the pin track 1515). In detail, an angle of inclination is defined to the angle formed by a line connecting two opposing ends of the pin track 1515 with respect to the top portion 1511 of the driving ring 151. In this embodiment, the pin track 1515 is a guide track having a slope. As shown in FIG. 3, the pin track 1515 is extended downward and toward the volute cover plate 102. Thereupon, as the driving ring 151 rotates with respect to the volute cover plate 102, the pin 13 would slide along the pin track 1515. Since the pin track 1515 is a guide track extending gradually toward the volute cover plate 102, thus as the pin 13 moves toward the volute cover plate 102, the pin 13 would drive the driving rod 18 to move toward the volute cover plate 102. In other words, through the pin 13 to slide along the corresponding pin track 1515, the driving rod 18 can move with respect to the driving ring 151 in an axial direction, and also the driving rod 18 moves the diffuser ring 19 synchronously so as to vary the flow-path width of the diffuser 11.

In this embodiment, in order to have the driving ring 151 to rotate with respect to the volute cover plate 102, the driving ring 151 would not move with respect to the volute cover plate 102 in the axial or radial direction of the driving ring 151. As shown in FIG. 2 and FIG. 3, this embodiment is furnished with the radial constraint assemblies 16 and the axial constraint assemblies 17, in which each of the radial constraint assemblies 16 disposed to the inner circumference surface 1516 of the driving ring 151 is used for restraining the driving ring 151 from moving in the radial direction of the driving ring 151, and each of the axial constraint assemblies 17 disposed to the outer circumference surface 1513 by being located between the top portion 1511 and the bottom portion 1512 is used for restraining the driving ring 151 from moving in the axial direction of the driving ring 151.

In this embodiment, four (but not limited) radial constraint assemblies 16 are included. In some other embodiments, the quantity of the radial constraint assemblies 16 can be three. In practice, referring now to FIG. 4A and FIG. 4B together, the radial constraint assembly 16 includes a fixation block 161, a slidable block 162 and a radial-bearing follower 163. As shown in FIG. 2 and FIG. 3, the radial constraint assembly 16 is fixed to the volute cover plate 102 via having locking elements A6 to lock the bottom flanges 161A of the fixation block 161 onto the volute cover plate 102. One end of the slidable block 162 is connected to the fixation block 161, while another end thereof is connected with the radial-bearing follower 163. Thereupon, the fixation block 161 as well as the slidable block 162 are integrated on the volute cover plate and inside the driving ring 151, particularly with the radial-bearing follower 163 to contact the inner circumference surface 1516 of the driving ring 151, so that the movement of the driving ring 151 in the radial direction can be limited. Namely, the local displacement of the driving ring 151 toward a center of the driving ring 151 can be limited.

In one embodiment of this disclosure, one protrusive end of the radial-bearing follower 163 is sleeved into a through hole H1 of the slidable block 162, and to be fixed with the slidable block 162 by a locking element 163A. In addition, a positioning element G1 is further applied laterally to lock the radial-bearing follower 163 from a lateral side of the slidable block 162, in which the positioning element G1 can be a socket set screw.

Figure 4B:
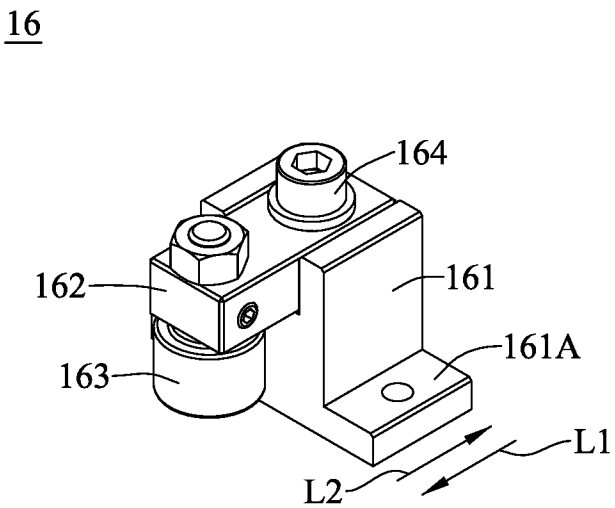
FIG. 4B is a schematic perspective view of FIG. 4A.
Figure 4A:
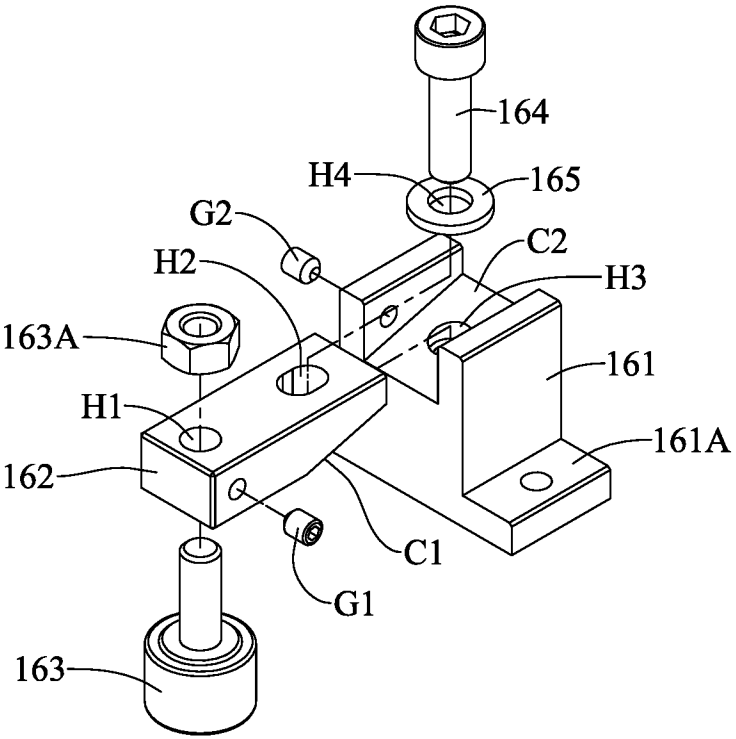
FIG. 4A is a schematic exploded view of the radial constraint assembly of FIG. 2.

Further, the radial constraint assembly 16 can further include an adjusting element 164, as shown in FIG. 4A and FIG. 4B. In this embodiment, the adjusting element 164 can be, but not limited to, a screw. The slidable block 162 has a first bevel plane C1 and an adjustment slot H2, and the fixation block 161 has a second bevel plane C2. The position of the adjustment slot H2 is different to that of the through hole H1, and the adjustment slot H2 can be a long adjustment slot. While in assembling, the adjusting element 164 penetrates orderly through a through hole H4 of the washer 165, the adjustment slot H2 of the slidable block 162, and the locking hole H3 of the fixation block 161. When the slidable block 162 is fixed to the fixation block 161, the first bevel plane C1 would match and thus slide over the second bevel plane C2. With the fastening of the adjusting element 164, the first bevel plane C1 of the slidable block 162 would slide over the second bevel plane C2 of the fixation block 161 in the first direction L1; i.e., in a direction to move the first bevel plane C1 of the slidable block 162 gradually away from the second bevel plane C2 of the fixation block 161. Namely, the radial-bearing follower 163 would move toward the fixation block 161 in the first direction L1. On the other hand, with the retrieving of the adjusting element 164, the first bevel plane C1 of the slidable block 162 would slide over the second bevel plane C2 of the fixation block 161 in a second direction L2; i.e., in a direction to move the first bevel plane C1 of the slidable block 162 to gradually overlap the second bevel plane C2 of the fixation block 161. Namely, the radial-bearing follower 163 would move toward the fixation block 161 in the second direction L2. Apparently, following the second direction L2, the radial-bearing follower 163 would move close to the fixation block 161; i.e., the second direction L2 is the reverse direction of the first direction L1. Upon such an arrangement, referring to FIG. 2, whenever an adjustment of the driving ring 151 in the radial direction is needed, all the adjusting elements 164 would be relieved firstly. Then, the driving ring 151 is moved to a new desired position, and simultaneously and automatically at least one of the adjusting elements 164 would be moved away to lose contact with the inner circumference surface 1516 of the driving ring 151 temporarily, with the rest of the adjusting elements 164 to keep contacting the inner circumference surface 1516 of the driving ring 151 but the respective slidable blocks 162 being slid accordingly over the corresponding fixation blocks 161 in the corresponding second directions L2. Then, through having the contact-loss radial-bearing followers 163 to resume contact with the inner circumference surface 1516 of the driving ring 151 via adjusting adequately the corresponding adjusting elements 164 in the corresponding first directions L1 so as to eliminate the aforesaid contact loss between the specific radial-bearing followers 163 and the inner circumference surface 1516 of the driving ring 151, thus the driving ring 151 would be surely relocated to the new position after all these four radial-bearing followers 163 are fixed to keep contacting the inner circumference surface 1516 of the driving ring 151.

Figure 5B:
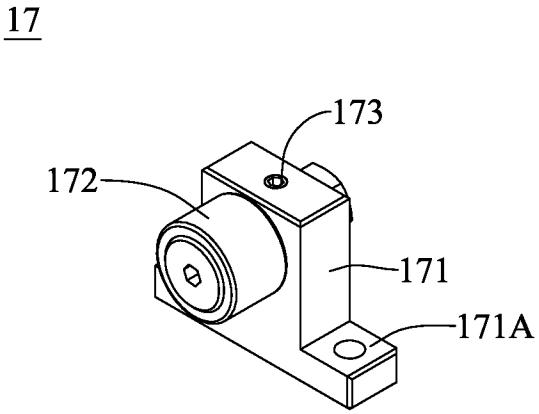
FIG. 5B is a schematic perspective view of FIG. 5A.
Figure 5A:
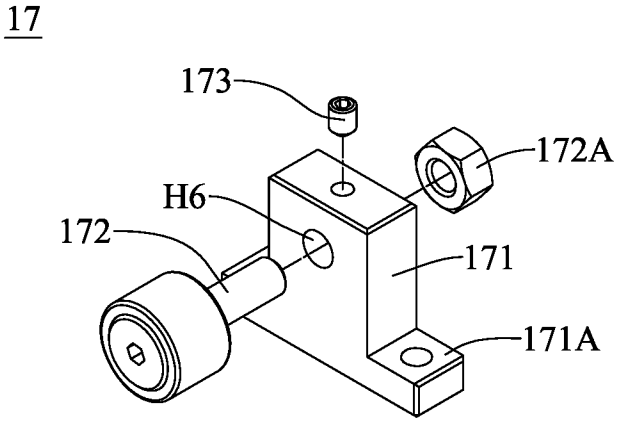
FIG. 5A is a schematic exploded view of the axial constraint assembly of FIG. 2.

Referring back to FIG. 2, in this embodiment, three axial constraint assemblies 17 are included. However, it shall be explained that, in this disclosure, the quantity of the axial constraint assemblies 17 are determined according to practical requirements. Referring to FIG. 5A and FIG. 5B, each of the axial constraint assemblies 17 includes a fixation block 171 and an axial-bearing follower 172. The axial constraint assembly 17 is fixed to the volute cover plate 102 by introducing at least one locking element A8 (see FIG. 2) to fix the corresponding bottom flange(s) 171A of the fixation block 171 to the volute cover plate 102. One protrusive end of the axial-bearing follower 172 is rotationally sleeved inside the pivotal hole H6 of the fixation block 171, and is then positioned by the locking element 172A. In addition, a positioning element 173 is further used to position the axial-bearing follower 172 from a top of the fixation block 171. In this embodiment, the positioning element 173 can be a socket set screw. As shown in FIG. 2, the axial-bearing follower 172, disposed exterior to the outer circumference surface 1513 of the driving ring 151, is located between the top portion 1511 and the bottom portion 1512 of the driving ring 151. With the axial-bearing followers 172, the axial movement of the driving ring 151 is limited. Namely, any axial movement, toward or outward, of the driving ring 151 with respect to the volute cover plate 102 is substantially prohibited.

Referring to FIG. 2, in this embodiment, the driving assembly 14 for rotating the driving ring 151 includes a drive device 141, a drive-device positioning frame 142, a coupling 143, a drive shaft 144, a drive shaft fixation block 145, a crank 146, a universal slider 147, a slider-driven slotted block 148 and a bushing 149. An axle 141A of the drive device 141 penetrates through the drive-device positioning frame 142 to further engage the coupling 143. Locking elements A1 and washers A2 are introduced to fix the drive device 141 to the volute base block 10. Locking elements A3 are used to fix the coupling 143 to the volute base block 10. One end of the coupling 143 is connected with the drive shaft 144, and a sealing element A4 is applied between the coupling 143 and the drive shaft 144 so as to enhance the sealing between the coupling 143 and the drive shaft 144. One end of the drive shaft 144 penetrates orderly through a through hole B2 of the volute base block 10, the bushing 149 and the drive shaft fixation block 145. The drive shaft fixation block 145 is fixed on the volute cover plate 102 by the locking elements A5. Thereupon, the drive device 141, a motor for example, can drive the axle 141A to rotate, and further to rotate the drive shaft 144 through the coupling 143.

In addition, the slider-driven slotted block 148 is fixed on the driving ring 151, and the universal slider 147 is movably disposed in the slider-driven slotted block 148. One end of the crank 146 is connected with the universal slider 147, while another end of the crank 146 is connected with the drive shaft 144. In addition, the axle of the driving ring 151 is crossed with the axle of the drive shaft 144 in an orthogonal manner. Under such an arrangement, the drive device 141 can rotate the drive shaft 144, and then the drive shaft 144 further rotates the crank 146 so as to have the universal slider 147 to reciprocally move along the slider-driven slotted block 148 and rotate the driving ring 151 simultaneously. In this embodiment, the crank 146 is swung to form an arc-shape motion track. To be driven by the crank 146, the driving ring 151 would have a rotational angle featured in a chord length equal to the chord length of the arc-shape motion track for the crank 146 to swing. Also, the rotational angle of the driving ring 151 is equal to that of the universal slider 147. In other words, the universal slider 147 works on the slider-driven slotted block 148 so as to transmit power to the driving ring 151 that mounts fixedly thereon the slider-driven slotted block 148. According to this embodiment, the rotational angle of the driving ring 151 can be arbitrarily changed by adjusting the chord length for the crank 14. In addition, when the driving ring 151 is rotated, all the pins 13 are driven to slide along the respective pin tracks 1515, and then the driving rods 18 moving with the corresponding pins 18 would be displaced to move the diffuser ring 19, such that the flow-path width of the diffuser 11 can be adjusted.

Thereupon, by varying the chord length of the crank 146, then the rotational angle of the driving ring 151 would be changed accordingly, the displacement of the diffuser ring 19 is thus adjusted to define the flow-path width of the diffuser 11. In the following description, FIG. 6A to FIG. 11 are utilized to elucidate three important positions of the diffuser ring 19 of this embodiment; i.e., an extending position, a middle position and a retrieving position. It shall be noted firstly that the extending position, the middle position and the retrieving position are simply three of many positions chosen to explain the effects that can be achieved by varying the flow-path width of the diffuser 11. According to this disclosure, the diffuser ring 19 can be dislocated to any position between the retrieving position and the extending position, and thereto different flow-path widths for the diffuser 11 can be obtained to demonstrate different effects.

Figure 6A:
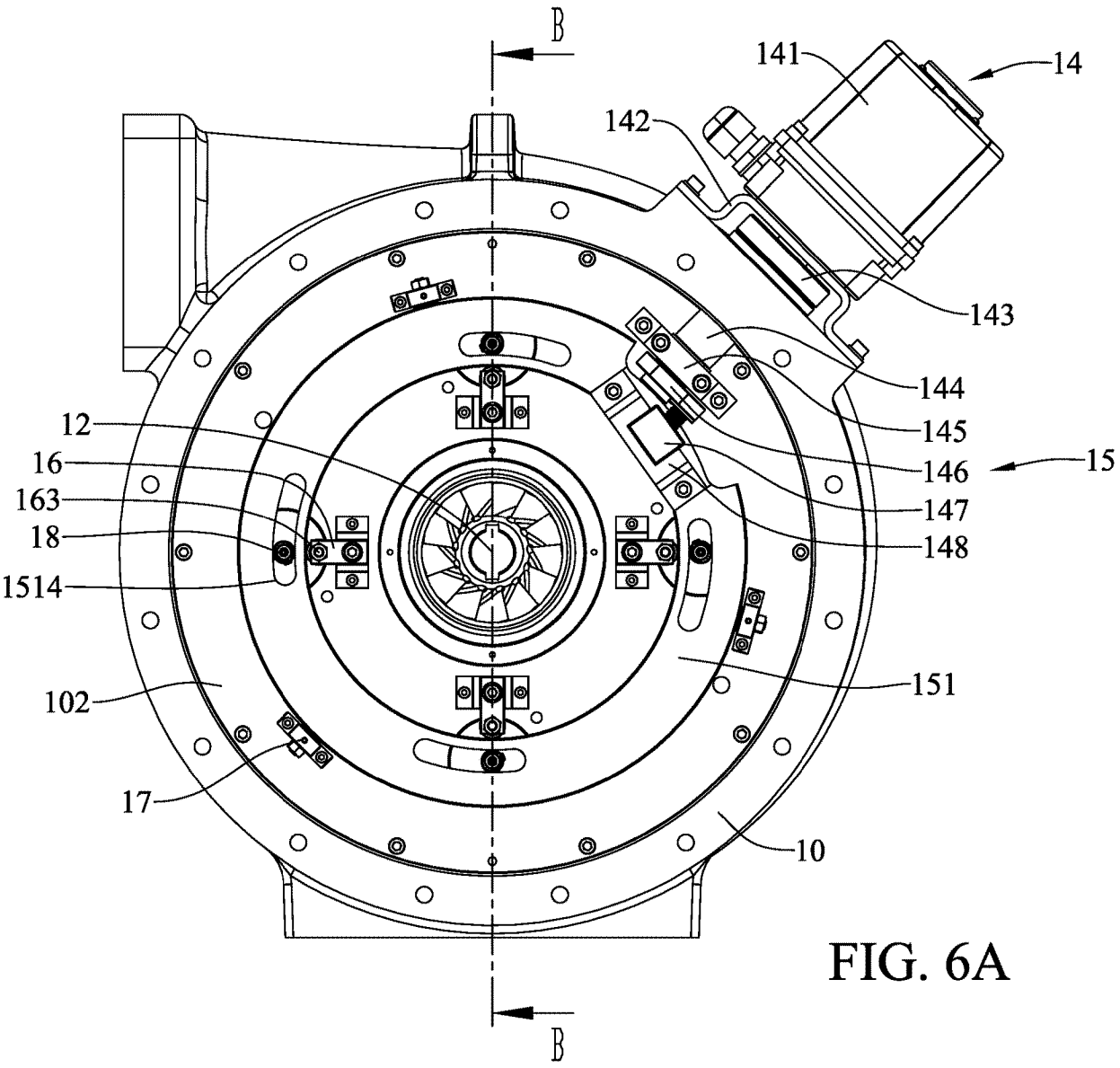
FIG. 6A demonstrates schematically the centrifugal compressor with the diffuser ring at an extending position in accordance with this disclosure.
Figure 6B:
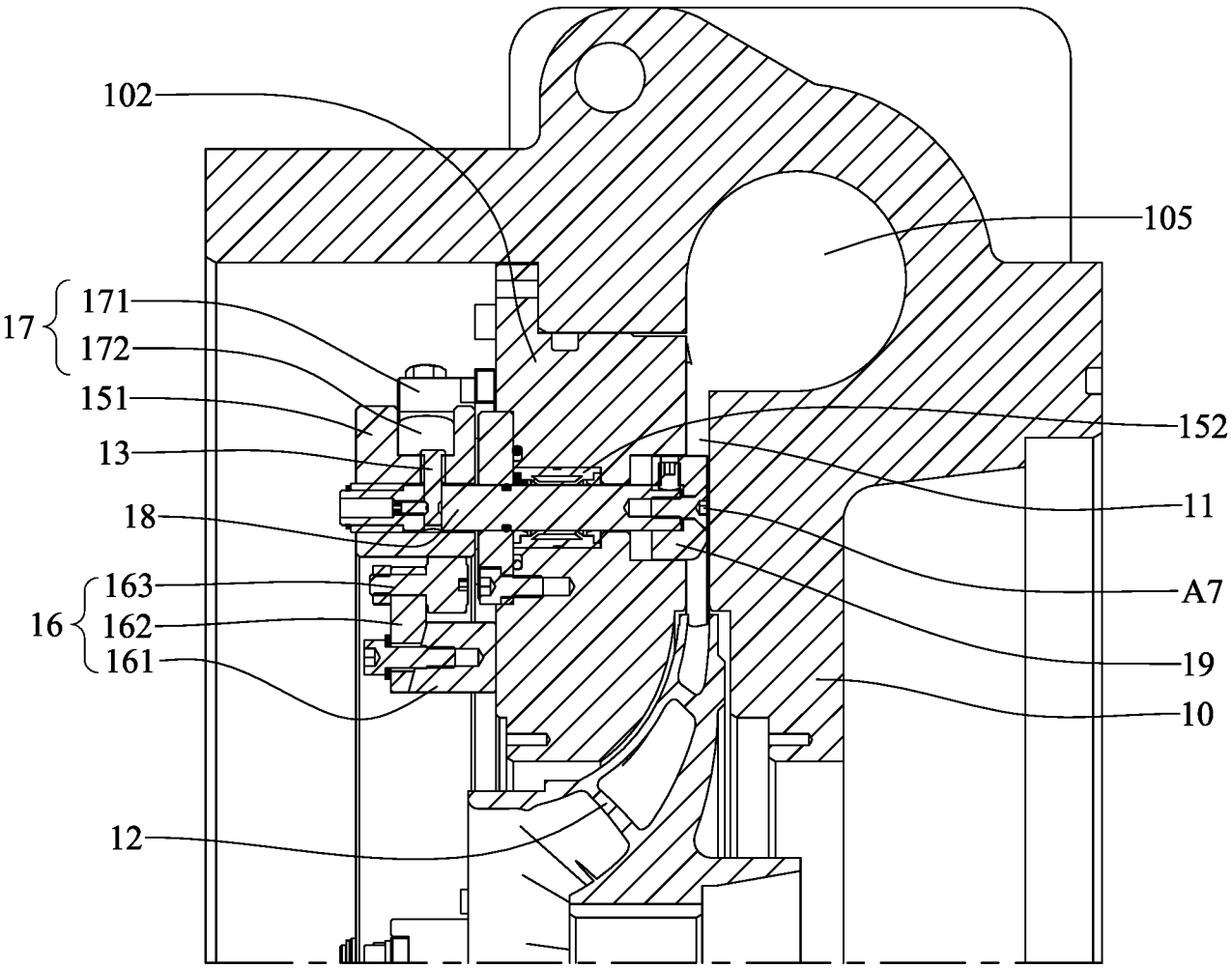
FIG. 6B is a schematic cross-sectional view of FIG. 6A along line B-B.
Figure 7:
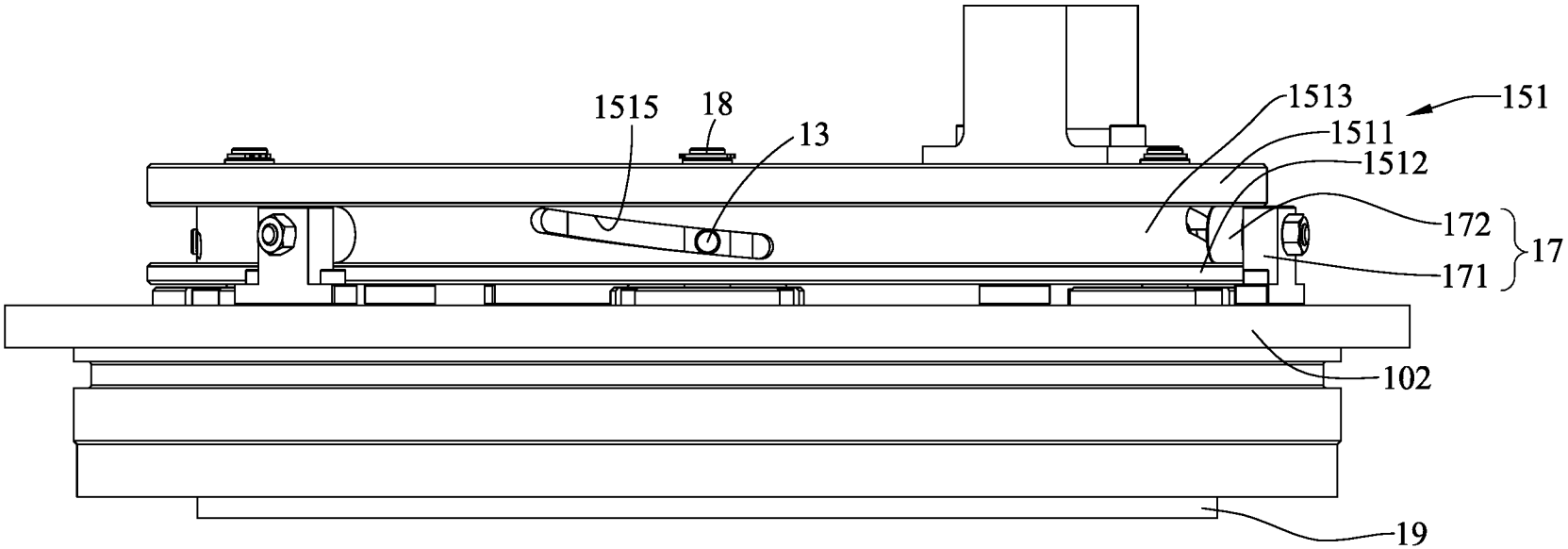
FIG. 7 is a schematic lateral side view of the diffuser-adjusting assembly of FIG. 6A.
Figure 8A:
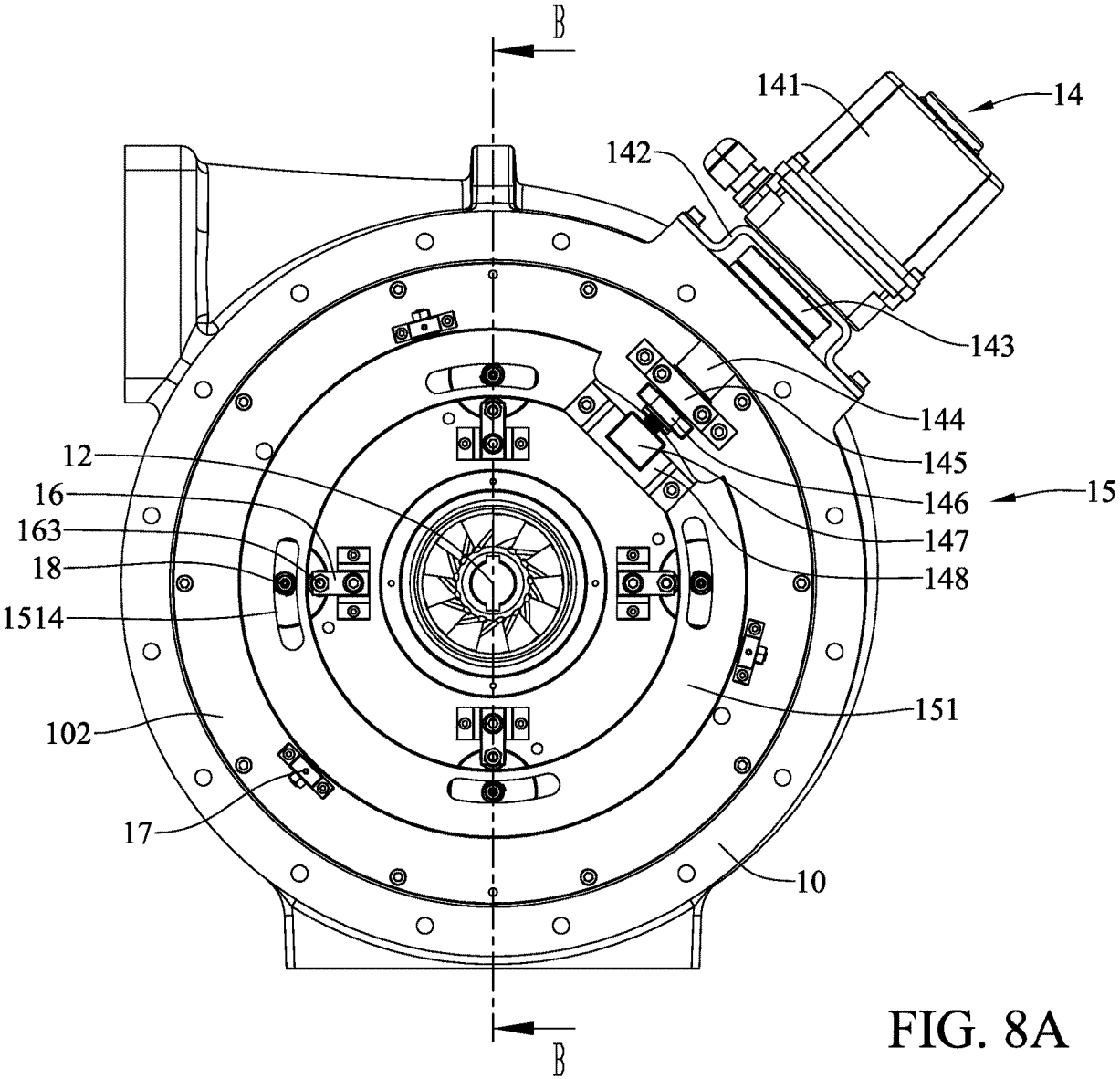
FIG. 8A demonstrates schematically the centrifugal compressor with the diffuser ring at a middle position in accordance with this disclosure.
Figure 8B:
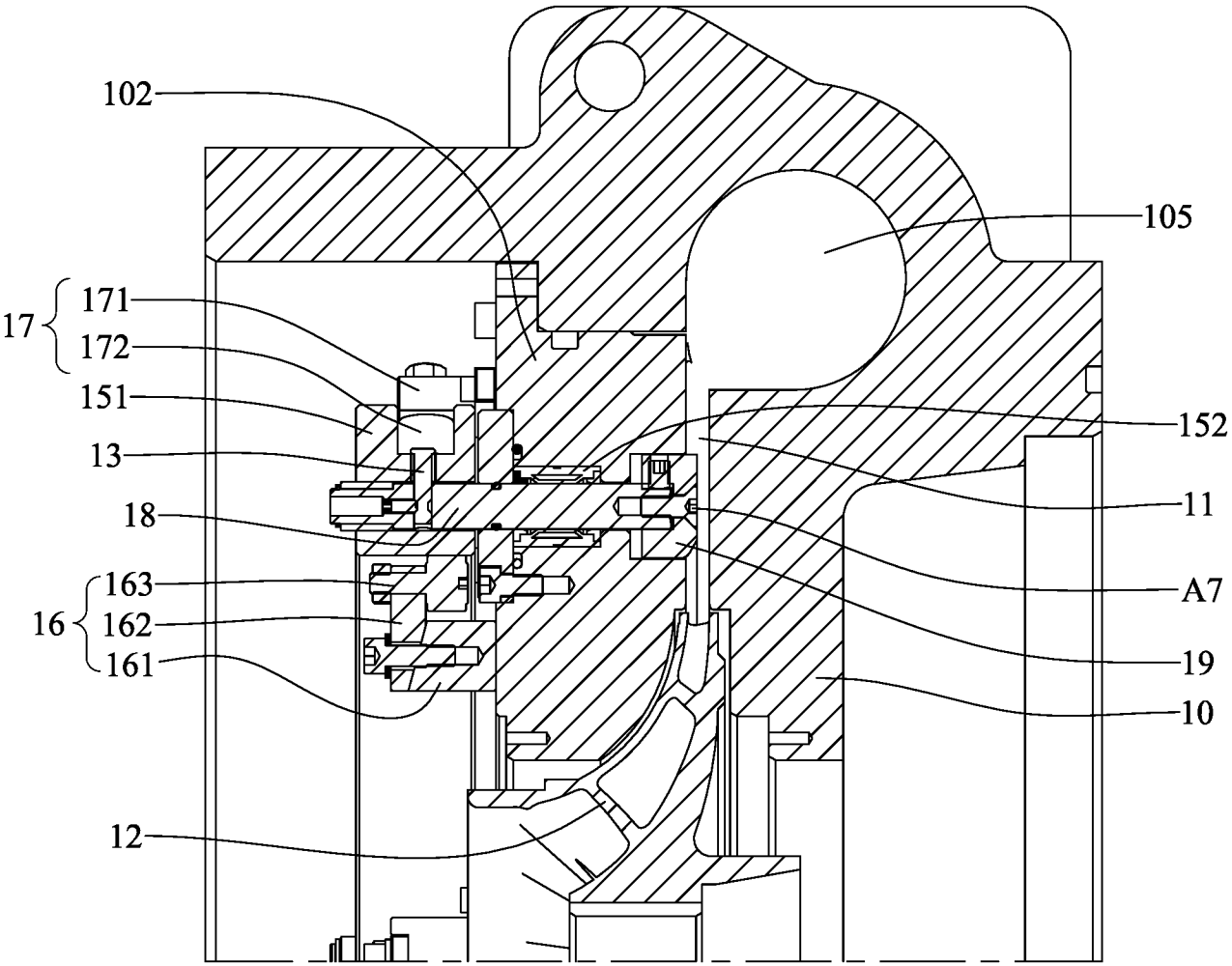
FIG. 8B is a schematic cross-sectional view of FIG. 8A along line B-B.
Figure 9:
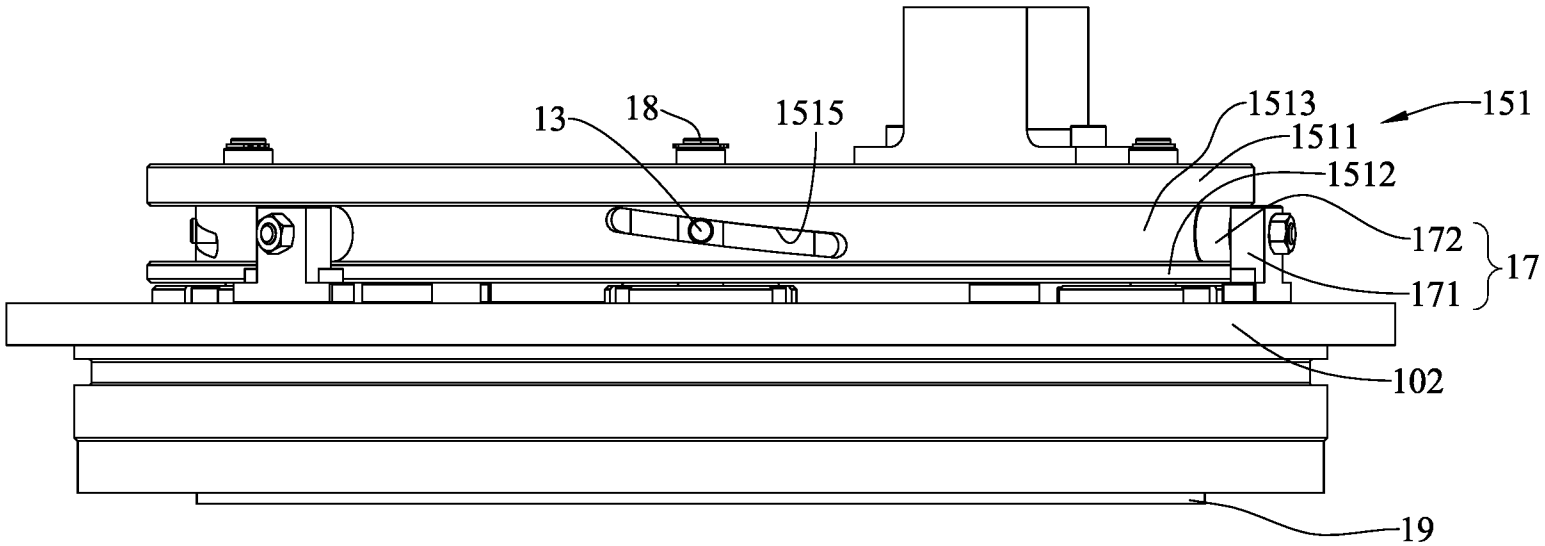
FIG. 9 is a schematic lateral side view of the diffuser-adjusting assembly of FIG. 8A.
Figure 10A:
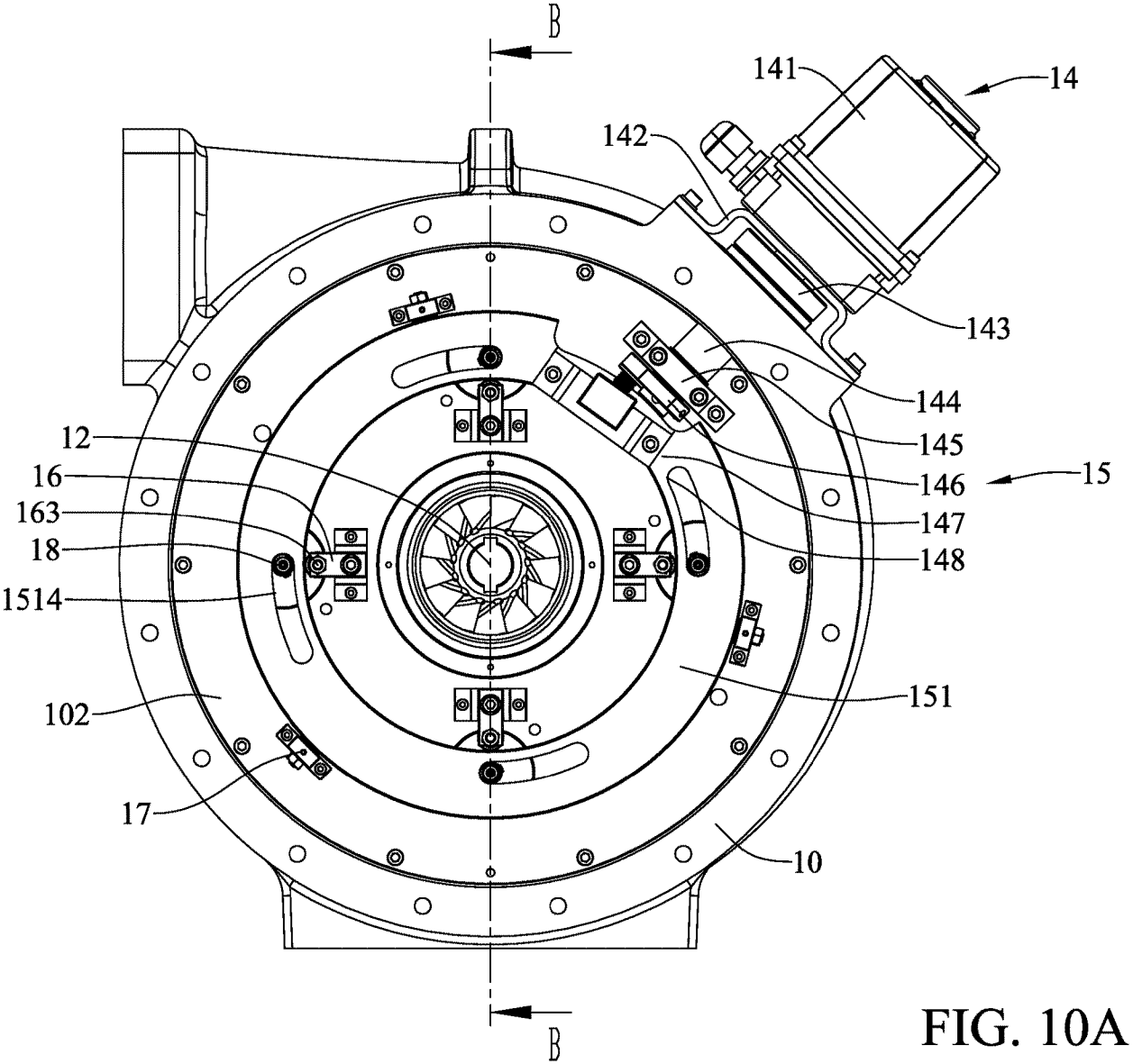
FIG. 10A demonstrates schematically the centrifugal compressor with the diffuser ring at a retrieving position in accordance with this disclosure.
Figure 10B:
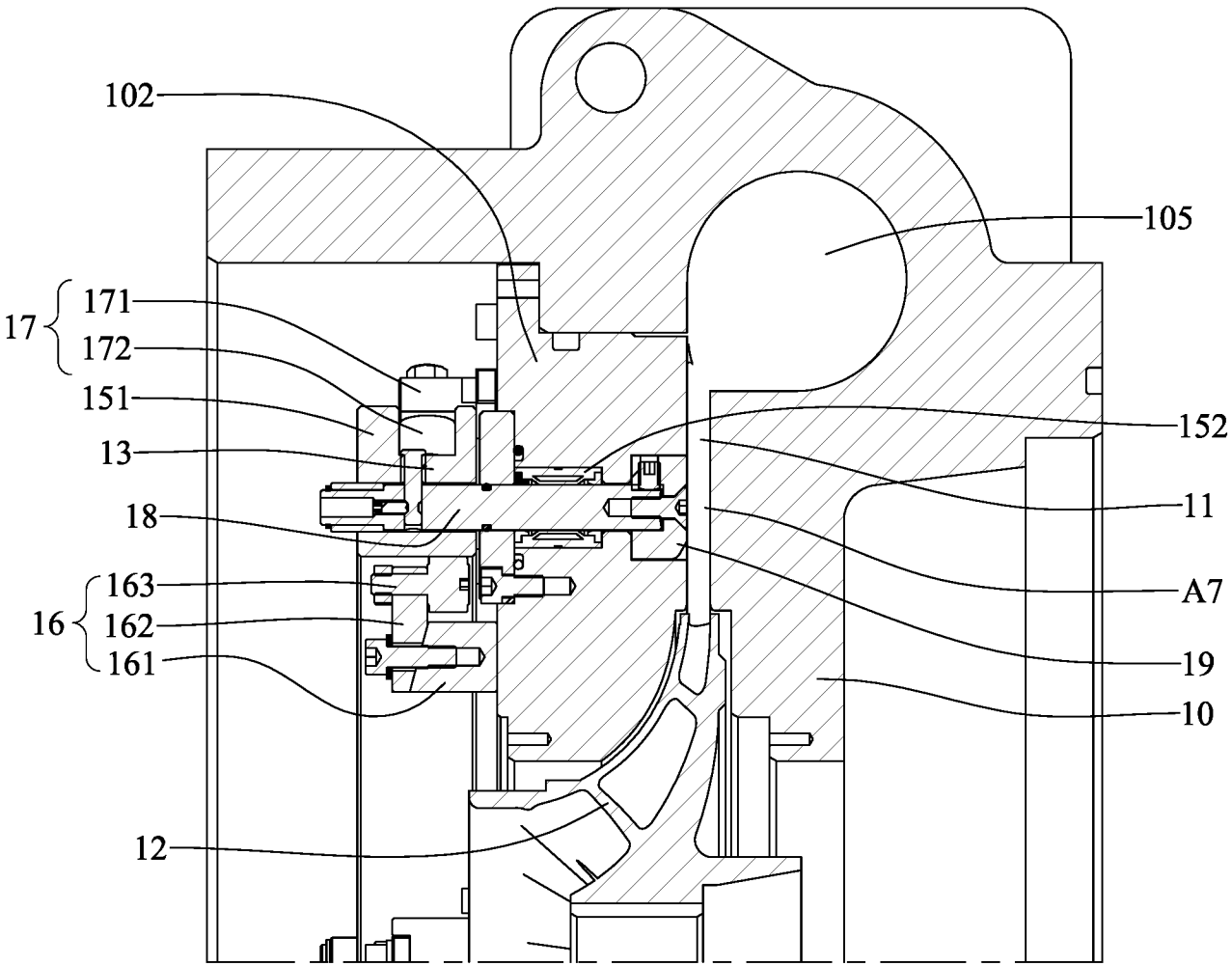
FIG. 10B is a schematic cross-sectional view of FIG. 10A along line B-B.
Figure 11:
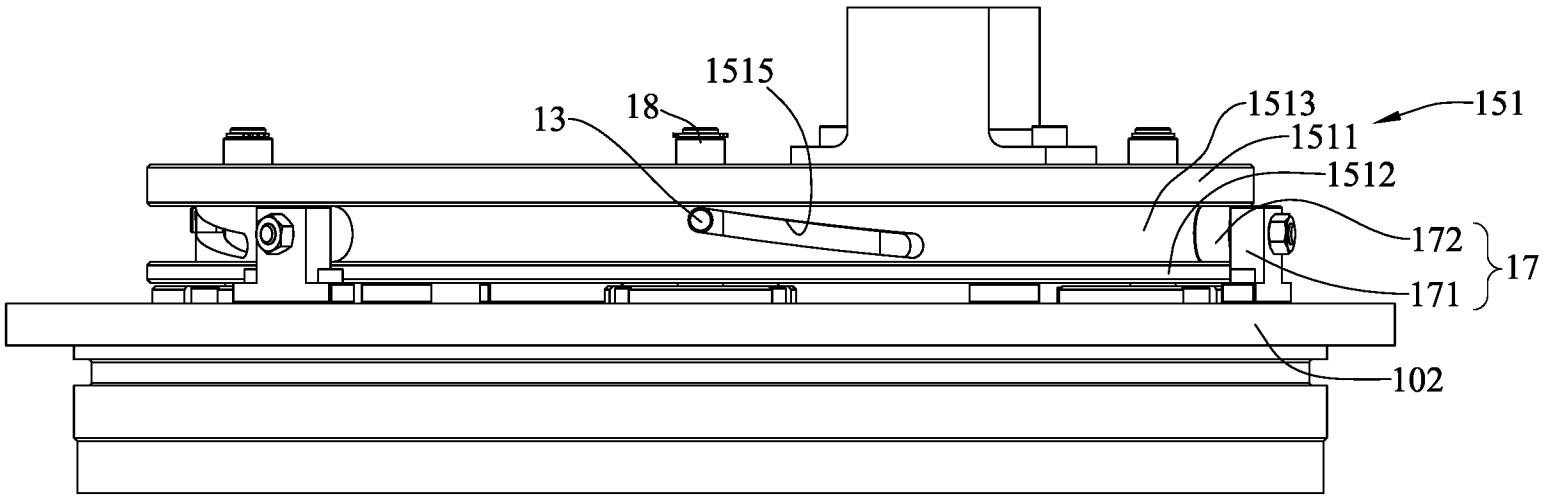
FIG. 11 is a schematic lateral side view of the diffuser-adjusting assembly of FIG. 10A.

As shown in FIG. 6A, FIG. 6B and FIG. 7, when the diffuser ring 19 is at the extending position, the diffuser ring 19 would cover completely the flow-path width of the diffuser 11. As shown in FIG. 7, the pin 13 is at a lower end of the corresponding pin track 1515; i.e., the position close to the volute cover plate 102. From the extending position shown in FIG. 6A, FIG. 6B and FIG. 7, the drive device 141 rotates to drive the drive shaft 144 to rotate simultaneously. Then, the drive shaft 144 drives the crank 146 to swing in the clockwise direction by 45° about the drive shaft 144. Accordingly, the universal slider 147 would slide in the slider-driven slotted block 148 and to rotate simultaneously the driving ring 151 in the counterclockwise direction, such that the pin 13 would move toward the top portion 1511 of the driving ring 151 to reach a position shown in FIG. 9. As shown in FIG. 8A, FIG. 8B and FIG. 9, when the diffuser ring 19 is at the middle position, half of the diffuser ring 19 covers the flow-path width of the diffuser 11. Herein, the state of the middle position also stands for a state that the a half of the flow-path width of the diffuser 11 is covered; i.e., only 50% of the flow-path width left. From the middle position shown in FIG. 8A, FIG. 8B and FIG. 9, the drive device 141 further rotates to rotate the drive shaft 144 simultaneously. The rotation of the drive shaft 144 would swing the crank 146 in the clockwise direction further by another by 45° about the drive shaft 144. Accordingly, the universal slider 147 would slide in the slider-driven slotted block 148 and to rotate simultaneously the driving ring 151 in the counterclockwise direction, such that the pin 13 would move toward the top portion 1511 of the driving ring 151 to reach a position shown in FIG. 11. In FIG. 11, the pin 13 slides along the corresponding pin track 1515 to a top end thereof (i.e., a position close to the top portion 1511 of the driving ring 151). As shown in FIG. 10A, FIG. 10B and FIG. 11, when the diffuser ring 19 is at the retrieving position, the diffuser ring 19 does not cover the flow-path width of the diffuser 11.

In summary, the centrifugal compressor provided by this disclosure connects the volute base block externally with the driving assembly, and thus rotational motion of the driving assembly can be transformed into linear motion of the diffuser ring via the driving ring. Thereupon, the flow-path width of the diffuser can be adjusted, the centrifugal compressor can work at a low load condition, and the surge phenomenon upon the compressor can be avoided by adjusting the flow-path width of the diffuser.

Further, since this disclosure discards the conventional design of locating the impeller into the inlet guide vane, thus notorious noise can be avoided, the structuring can be more concise, and a more silent operation can be obtained.

In addition, the radial constraint assembly of this disclosure provides slope planes to match each other, so that, as the adjusting elements are fastened, the position of the radial-bearing follower can be varied to adjust radially the position of the driving ring.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A centrifugal compressor, comprising:

a volute base block;

a volute cover plate, disposed inside the volute base block, forming a diffuser and a volute in between with the volute base block, the volute connecting spatially with the diffuser;

an impeller, having an outlet connected spatially with the diffuser;

a diffuser-adjusting assembly, movably disposed inside the volute base block, including a driving ring, at least three driving rods, at least three pins and a diffuser ring; wherein the driving ring is rotationally disposed on the volute cover plate, the driving ring includes at least three drive-rod slots and at least three pin tracks, each of the at least three drive-rod slots is disposed at the driving ring and structured to penetrate through a top portion and a bottom portion of the driving ring, each of the at least three pin tracks is disposed on an outer circumference surface of the driving ring, each of the at least three driving rods is connected with the corresponding pin, each of the at least three driving rods penetrates through the corresponding drive-rod slot and the volute cover plate, one end of each of the at least three driving rods is connected with the diffuser ring, the diffuser ring is located close to the diffuser, and each of the at least three pins is movably disposed in the corresponding pin track;

at least three radial constraint assemblies, each of the at least three radial constraint assemblies being disposed to an inner circumference surface of the driving ring;

at least three axial constraint assemblies, each of the at least three axial constraint assemblies being disposed to the outer circumference surface of the driving ring by being located between the top portion and the bottom portion; and a driving assembly, used for rotating the driving ring, including a drive device, a coupling, a drive shaft, a crank, a universal slider and a slider-driven slotted block, the slider-driven slotted block being fixed on the driving ring, the universal slider being movably disposed in the slider-driven slotted block, one end of the crank being connected with the universal slider while another end thereof is connected with the drive shaft; wherein, when the drive device rotates the drive shaft, the drive shaft drives the crank to swing about the drive shaft, such that the universal slider moves reciprocally along the slider-driven slotted block and rotates the driving ring simultaneously; wherein, when the driving ring rotates, each of the at least three pins slides along the corresponding pin track, and thus each of the at least three driving rods is driven to displace the diffuser ring, so that a flow-path width of the diffuser is adjusted.

2. The centrifugal compressor of claim 1, wherein a chord length of an arc-shape motion track for the the crank to swing is equal to another chord length of a rotational angle of the driving ring.

3. The centrifugal compressor of claim 1, wherein an axle of the driving ring is crossed with another axle of the drive shaft in an orthogonal manner.

4. The centrifugal compressor of claim 1, wherein the diffuser-adjusting assembly further includes at least three bearings, and each of the at least three bearings sleeves the corresponding driving rod so as to allow the driving rod to be movable with respect to the corresponding bearing.

5. The centrifugal compressor of claim 1, wherein each of the radial constraint assemblies includes a fixation block, a slidable block and a radial-bearing follower, the fixation block is fixed onto the volute cover plate, and one end of the slidable block is connected to the fixation block while another end thereof is connected with the radial-bearing follower, so that the radial-bearing follower contacts the inner circumference surface of the driving ring to restrain the driving ring from moving in a radial direction of the driving ring.

6. The centrifugal compressor of claim 5, wherein each of the radial constraint assemblies further includes an adjusting element, the slidable block has a first bevel plane and an adjustment slot, and the fixation block has a second bevel plane; wherein, when the adjusting element penetrates through the adjustment slot to lock the slidable block onto the fixation block, the first bevel plane of the slidable block slides over the second bevel plane of the fixation block so as to move the radial-bearing follower away from the fixation block.

7. The centrifugal compressor of claim 6, wherein the second bevel plane is to match the first bevel plane.

8. The centrifugal compressor of claim 1, wherein the outer circumference surface are formed between the bottom portion and the top portion, each of the pin tracks is disposed on the outer circumference surface by being located between the top portion and the bottom portion, each of the axial constraint assemblies includes a fixation block and an axial-bearing follower, the fixation block is fixed to the volute cover plate, and one end of the axial-bearing follower is rotationally sleeved inside the fixation block while another end thereof contacts the driving ring at a place between the top portion and the bottom portion, so that the axial-bearing follower restrains the driving ring from moving in an axial direction of the driving ring.

9. The centrifugal compressor of claim 1, wherein each of the pin tracks extends downward and toward the volute cover plate.

* * * * *